US010906164B2

(12) United States Patent
Gelston et al.

(10) Patent No.: US 10,906,164 B2
(45) Date of Patent: Feb. 2, 2021

(54) IMMOBILIZER TOOL SET FOR BOLT INSTALLATION AND METHOD

(71) Applicant: United Technologies Corporation, Farmington, CT (US)

(72) Inventors: Todd H. Gelston, East Haddam, CT (US); Jesse T. Carmicheal, Vernon, CT (US); Sandi Elhibir, Avon, CT (US); Zachary Jonathan McGillivary, Windsor Locks, CT (US); R. H. Pangretic, East Hampton, CT (US); Gregory C. Schmidt, Portland, CT (US); Daniel P. Tallman, Wellington, FL (US); Scott A. Wagner, Stuart, FL (US); Ricky Scott, Clinton, CT (US); Michael J. Woodward, Columbia, CT (US); Michael Joseph Manzi, Plantsville, CT (US)

(73) Assignee: RAYTHEON TECHNOLOGIES CORPORATION, Waltham, MA (US)

( * ) Notice: Subject to any disclaimer, the term of this patent is extended or adjusted under 35 U.S.C. 154(b) by 216 days.

(21) Appl. No.: 16/015,952

(22) Filed: Jun. 22, 2018

(65) Prior Publication Data

US 2019/0389043 A1 Dec. 26, 2019

(51) Int. Cl.
*B25B 27/14* (2006.01)
*F01D 25/24* (2006.01)

(52) U.S. Cl.
CPC ..... *B25B 27/14* (2013.01); *F01D 25/243* (2013.01); *F05D 2220/32* (2013.01); *F05D 2230/60* (2013.01); *F05D 2260/31* (2013.01); *F05D 2260/38* (2013.01); *F05D 2260/52* (2013.01)

(58) Field of Classification Search
CPC ..... B23B 23/08; B23B 23/10; B23P 19/061; B25B 27/14; B25B 23/10; B25B 23/0085; F01D 25/243; F01D 25/285; F05D 2260/38; F05D 2220/32; F05D 2230/60; F05D 2260/31; F05D 2260/52
See application file for complete search history.

(56) References Cited

U.S. PATENT DOCUMENTS

| | | | | |
|---|---|---|---|---|
| 300,968 A * | 6/1884 | Hatfield | ..... | B25B 23/0085 81/13 |
| 1,334,352 A | 3/1920 | Dehn | | |
| 1,596,678 A * | 8/1926 | Miller | ..... | B25B 9/00 29/270 |
| 2,519,157 A | 8/1950 | Stacey | | |

(Continued)

FOREIGN PATENT DOCUMENTS

| | | | |
|---|---|---|---|
| CN | 109048785 A | * | 12/2018 |
| EP | 1714936 A1 | | 10/2006 |

OTHER PUBLICATIONS

Extended European Search Report dated Nov. 22, 2019, received for corresponding European Application No. 19181309.6.

*Primary Examiner* — Jacob J Cigna
(74) *Attorney, Agent, or Firm* — Kinney & Lange, P.A.

(57) ABSTRACT

An immobilizer tool set includes a plurality of retention blocks. Each retention block of the plurality of retention blocks includes a first plate, a guide pin extending from the first plate, and a second plate on the guide pin and configured to slide on the guide pin relative the first plate. A spring is between the first plate and the second plate.

18 Claims, 7 Drawing Sheets

(56) References Cited

U.S. PATENT DOCUMENTS

| | | | | |
|---|---|---|---|---|
| 2,829,548 | A * | 4/1958 | Byrd | B25B 9/00 29/270 |
| 4,104,936 | A * | 8/1978 | Sjostrom | B25B 23/08 81/180.1 |
| 4,256,157 | A * | 3/1981 | Grayson | B25B 23/08 81/44 |
| 4,478,444 | A * | 10/1984 | Kurz | E05B 63/20 292/333 |
| 4,872,645 | A * | 10/1989 | Dossier | B25B 27/304 254/10.5 |
| 5,169,399 | A * | 12/1992 | Ryland | A61F 2/4609 606/91 |
| 6,560,836 | B1 * | 5/2003 | Briscoe | B25B 27/023 29/259 |
| 6,609,282 | B2 * | 8/2003 | Morrissey | B25B 27/20 29/229 |
| 6,925,909 | B2 * | 8/2005 | Crosby | B25B 9/02 81/44 |
| 7,367,766 | B2 | 5/2008 | Dao et al. | |
| 8,535,323 | B2 * | 9/2013 | Keefer | A61F 2/4637 606/91 |
| 9,890,658 | B2 * | 2/2018 | Gerzner | F01D 17/085 |
| 2014/0366353 | A1 * | 12/2014 | Iwahashi | B23P 21/002 29/281.4 |
| 2017/0108009 | A1 | 4/2017 | Obereich | |

* cited by examiner

IMMOBILIZER TOOL SET FOR BOLT INSTALLATION AND METHOD

BACKGROUND

The present disclosure relates to gas turbine engines and methods for assembling a shaft to a rear drum of a compressor section for a gas turbine engine.

A gas turbine engine on an aircraft typically includes a fan section, a low-pressure compressor section, a high-pressure compressor section, a combustor section, a high-pressure turbine section, and a low-pressure turbine section. An inner shaft rotationally couples the low-pressure compressor section to the low-pressure turbine section, and an outer shaft rotationally couples the high-pressure compressor to the high-pressure turbine section. At an aft end, the high-pressure compressor includes a rear drum that transitions the high-pressure compressor to the outer shaft. Typically, the rear drum is fastened to the outer shaft by bolts and nuts.

During assembly of the gas turbine engine, the high-pressure compressor section is assembled in the vertical position, and the outer shaft is mated vertically onto the rear drum and the bolts. The nuts are placed onto the bolts after the outer shaft is mated onto the rear drum and the bolts. Since the rear drum and the outer shaft are assembled in the vertical position, the heads of the bolts need to be connected to the rear drum to prevent the bolts from falling out of position while the outer shaft is mated onto the rear drum and the bolts. Specialized washers with tangs have been used in the past to connect the bolts to the rear drum. The tangs on the washers require bending after the bolts and washers are installed on the rear drum. A hammer is sometimes used to bend the tangs of the washers. The rear drum can be damaged by the hammer should the hammer strike the rear drum while bending the tangs.

SUMMARY

In one aspect of the invention, an immobilizer tool set includes a plurality of retention blocks. Each retention block of the plurality of retention blocks includes a first plate, a guide pin extending from the first plate, and a second plate on the guide pin and configured to slide on the guide pin relative the first plate. A spring is between the first plate and the second plate.

In another aspect of the invention, a method is disclosed for retaining bolts and washers on a rear drum of a gas turbine engine high-pressure compressor section prior to assembling a shaft to the rear drum. The method includes installing the washers on the bolts, and inserting the bolts through holes formed on a first end of the rear drum such that bolt heads of the bolts and the washers are positioned axially between the first end and a second end of the rear drum. The method further includes attaching work nuts to the bolts and installing a plurality of spring-loaded retention blocks between the second end of the rear drum and the bolt heads. Installing the plurality of spring-loaded retention blocks further includes compressing each spring-loaded retention block, inserting each compressed spring-loaded retention block between the bolt heads and the second end of the rear drum, and decompressing each spring-loaded retention block such that each spring-loaded retention block contacts the second end of the rear drum and at least one of the bolt heads.

In another aspect of the invention, a method is disclosed for assembling a shaft to a rear drum of a high-pressure compressor section in a gas turbine engine. The method includes installing washers onto bolts and inserting the bolts through a first set of holes formed on a first end of the rear drum such that bolt heads of the bolts and the washers are positioned axially between the first end and a second end of the rear drum. The method further includes attaching work nuts to the bolts and installing a plurality of retention blocks between the second end of the rear drum and the bolt heads. The plurality of retention blocks are installed by compressing each retention block, inserting each compressed retention block between the second end of the rear drum and the bolt heads, and decompressing each retention block such that each retention block contacts the second end of the rear drum and at least one of the bolt heads. The method further includes removing the work nuts from the bolts, aligning a flange of the shaft with the first end of the rear drum such that the bolts extend through a second set of holes formed in the flange of the shaft, and attaching assembly nuts to the bolts.

Persons of ordinary skill in the art will recognize that other aspects and embodiments of the present invention are possible in view of the entirety of the present disclosure, including the accompanying figures.

Figure 1:
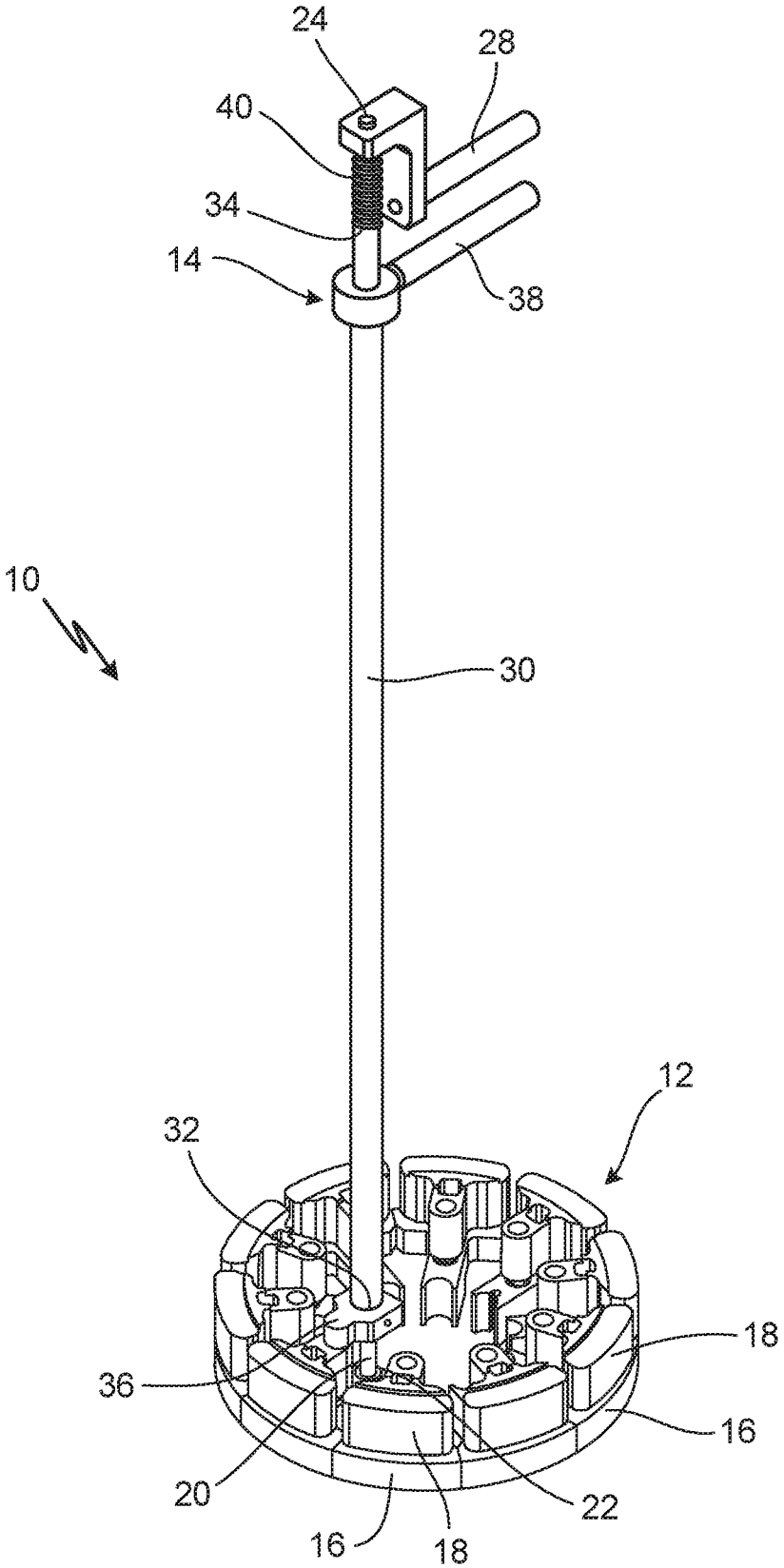
FIG. 1 is a perspective view of an immobilizing tool set with a plurality of retention blocks and a gripper tool.

While the above-identified drawing figures set forth one or more embodiments of the invention, other embodiments are also contemplated. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings. Like reference numerals identify similar structural elements.

DETAILED DESCRIPTION

The present disclosure provides a tool set and method for immobilizing bolts on a rear drum of a high-pressure compressor section in a gas turbine engine. As described below with reference to the Figures, the tool set immobilizes the bolts on the rear drum prior to installing a shaft onto the rear drum and the bolts. The tool set includes a plurality of retention blocks. Each retention block can be inserted inside the rear drum and compressed between bolt heads of the bolts and an end or hub of the rear drum. The plurality of retention blocks back-up the bolt heads and prevent the bolts from falling or being pushed out of place when the shaft is mated onto the rear hub and bolts. The tool set can also include an elongated gripper tool that reaches through the shaft to grab, compress, and remove each of the plurality of retention blocks after the shaft is fastened to the rear hub.

Figure 2A:
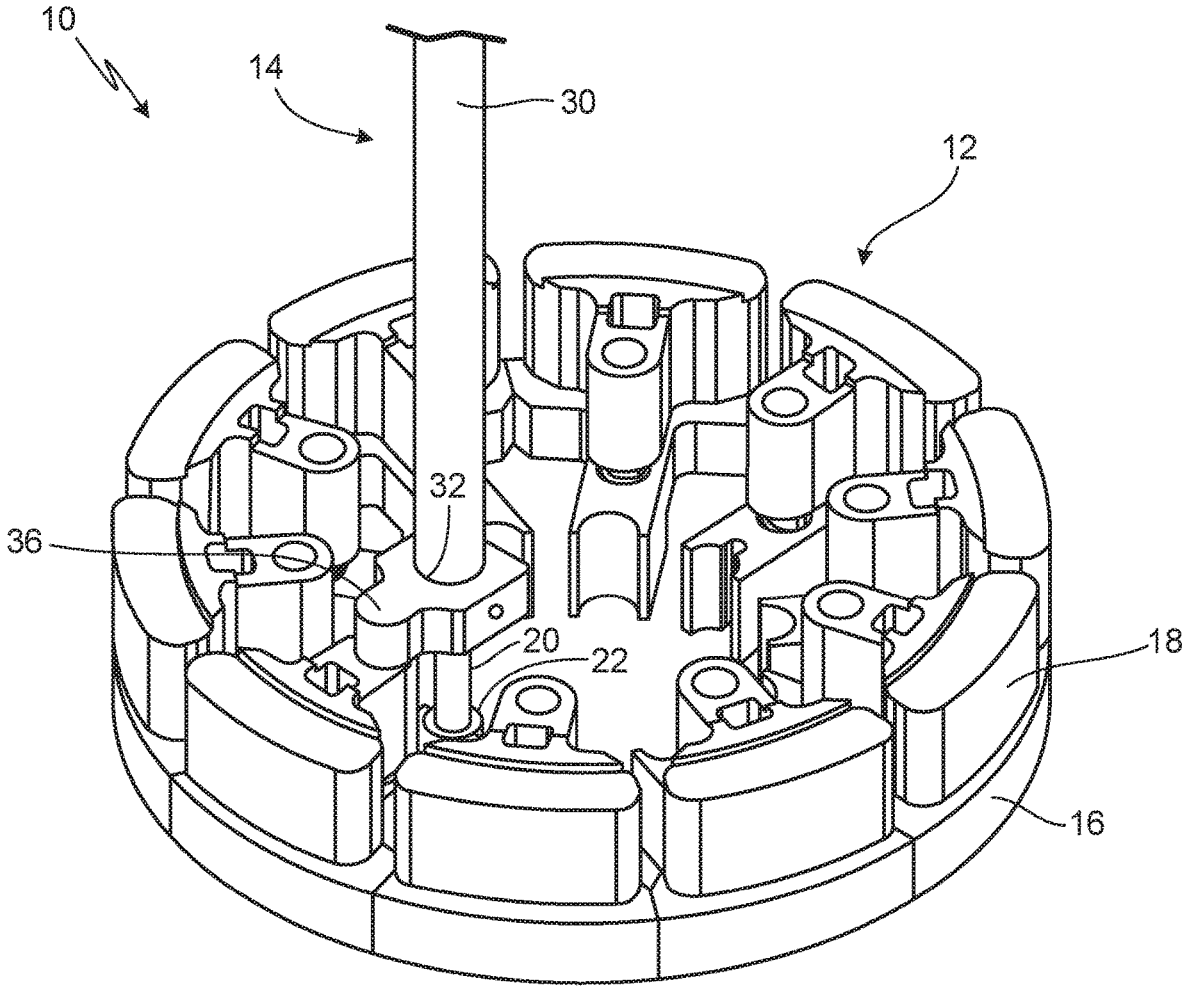
FIG. 2A is an enlarged perspective view of the plurality of retention blocks and a working end of the gripper tool from FIG. 1.
Figure 2B:
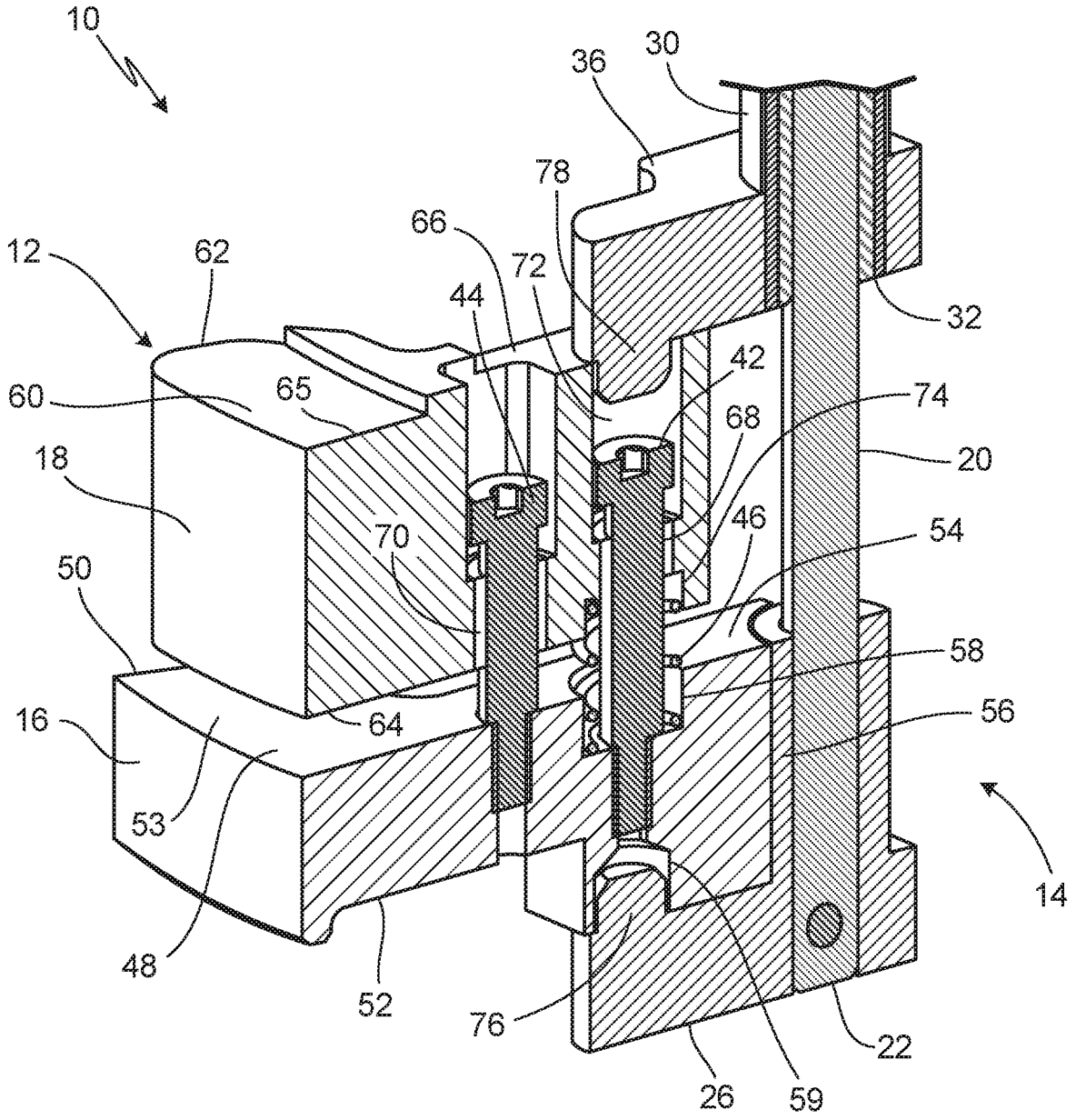
FIG. 2B is a cross-sectional view of the working end of the gripper tool and one of the retention blocks from FIG. 2A.
Figure 2C:
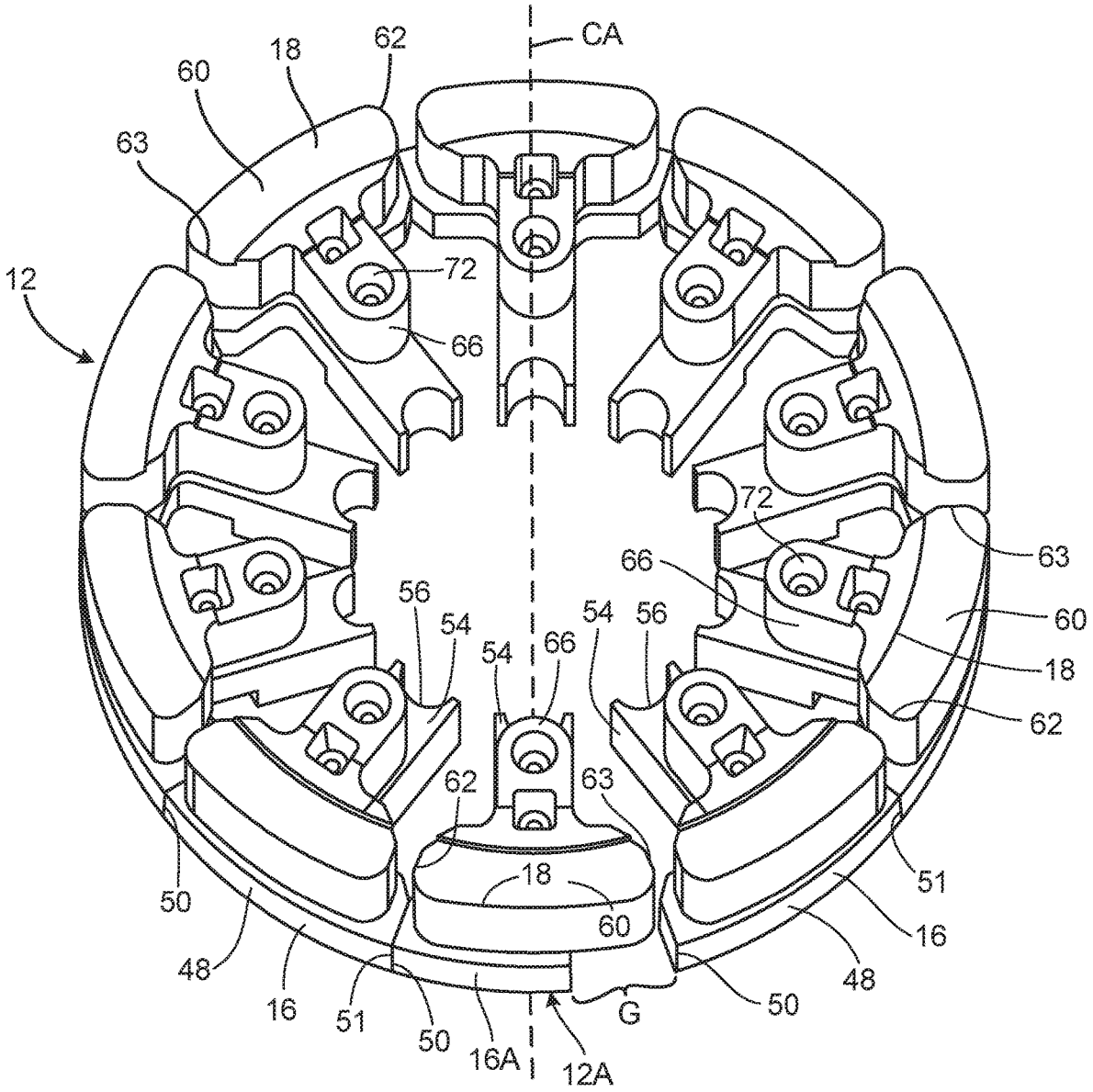
FIG. 2C is another perspective view of the plurality of retention blocks from FIG. 2A.

FIGS. 1-2C will be discussed concurrently. FIG. 1 is a perspective view of tool set 10, which includes a plurality retention blocks 12 and gripper tool 14. FIG. 2A is an enlarged perspective view of gripper tool 14 grasping one of retention blocks 12. FIG. 2B is a cross-sectional view of one of retention blocks 12 and a gripping end of gripper tool 14. FIG. 2C is a top perspective view of retention blocks 12 from FIG. 2A. As shown collectively in FIGS. 1-2C, each retention block 12 includes first plate 16 and second plate 18. Gripper tool 14 includes bar 20 with first end 22 and second end 24. Gripper tool 14 also includes first jaw 26 (shown best in FIG. 2B), first handle 28, tube 30 with first end 32 and second end 34, second jaw 36, second handle 38, and gripper spring 40. As shown best in FIGS. 2B and 2C, each retention block 12 further includes first guide pin 42, second guide pin 44, and block spring 46. First plate 16 includes head 48 with first end 50 and second end 51 (shown in FIG. 2C), first surface 52, second surface 53, stem 54, gripper seat 56, first spring seat 58, and first recess 59. Second plate 18 includes body 60 with first end 62 and second end 63 (shown in FIG. 2C), first surface 64, second surface 65, projection 66, first guide hole 68, second guide hole 70, second recess 72, and second spring seat 74. First jaw 26 includes first nub 76, and second jaw 36 includes second nub 78.

Each retention block 12 is shaped so that the plurality of retention blocks 12 can be arranged together to form a circle about center axis CA. Each retention block 12 is formed by first plate 16 and second plate 18. As shown best in FIGS. 2B and 2C, first plate 16 has a general "T" shaped profile formed by head 48 and stem 54. Head 48 extends circumferentially between first end 50 and second end 51 relative center axis CA, and extends axially between first surface 52 and second surface 53 relative center axis CA. Stem 54 extends radially inward from head 48 and toward center axis CA. First end 50 and second end 51 of head 48 can be angled or tapered such that a circumferential length of head 48 between first end 50 and second end 51 tapers radially inward. The tapered circumferential length of head 48 on first plate 16 allows the plurality of retention blocks to be assembled against each other into a circle about center axis CA. As shown in FIG. 2C, the plurality of retention blocks 12 includes one retention block 12A with a modified first plate 16A. Second end 51 of head 48 is removed on modified first plate 16A up to stem 54. Removing second end 51 from head 48 on modified first plate 16A forms gap G between first plate 16A and an adjacent first plate 16 of another retention block 12 when all of the retention blocks 12 are abutted together in a circle around center axis CA. Gap G provides enough clearance to allow retention block 12A to be assembled into the circle starting from center axis CA or removed from the circle by pulling retention block 12A toward center axis CA.

Second plate 18 of each retention block 12 also has a general "T" shaped profile formed by body 60 and projection 66. As shown best in FIGS. 2B and 2C, body 60 extends circumferentially between first end 62 and second end 63 relative center axis CA, and extends circumferentially between first surface 64 and second surface 65. Projection 66 extends radially inward from body 60 relative center axis CA. Body 60 on each retention block 12 is circumferentially shorter than respective head 48 so that body 60 does not interfere when the plurality of retention blocks 12 are assembled together into a circle. Retention block 12A is an exception because head 48 of plate 16A is modified such that head 48 on plate 16A is circumferentially shorter than body 60 on retention block 12A.

Shown best in FIG. 2B, in each retention block 12, first guide pin 42 and second guide pin 44 connect second plate 18 to first plate 16. First guide pin 42 and second guide pin 44 are both positioned on stem 54 and extend axially from stem 54 of first plate 48 and into projection 66 of second plate 18. First guide hole 68 and second guide hole 70 are formed in projection 66 of second plate 18 and receive first guide pin 42 and second guide pin 44 respectively. First guide hole 68 and second guide hole 70 are sized large enough to allow second plate 18 to slide and/or move axially on first guide pin 42 and second guide pin 44 relative first plate 16. Block spring 46 is between first plate 16 and second plate 18 biases second plate 18 away from first plate 16. As shown in the embodiment of FIG. 2B, block spring 46 is a coil spring 46 disposed around first guide pin 42 and compressed between stem 54 and projection 66. First spring seat 58 and second spring seat 74 are formed on second surface 53 of first plate 16 and first surface 64 of second plate 18 respectively to accommodate block spring 46 between first plate 16 and second plate 18. The strength of block spring 46 is sized so that first plate 16 and second plate 18 can be squeezed together by hand. Gripper tool 14 is provided to squeeze first plate 16 and second plate 18 together when retention blocks 12 cannot be reached by hand.

Gripper tool 14 is shown best in FIGS. 1-2B. Bar 20 of gripper tool 14 extends between first end 22 and second end 24. First jaw 26 (shown in FIG. 2B) is connected to first end 22 of bar 20. First handle 28 is connected to second end 24 of bar 20. Tube 30 extends between first end 32 of tube 30 and second end 34 of tube 30. Bar 20 is longer than tube 30 and extends through tube 30. Second jaw 36 is connected to first end 32 of tube 30 and second handle 38 is connected to second end 34 of tube 30. Gripper spring 40 is a coil spring 40 disposed around bar 20 and extends between second end 34 of tube 30 and first handle 28. Gripper spring 40 is compressed between second end 34 of tube 30 and first handle 28 and biases second jaw 36 toward first jaw 26. First jaw 26 and second jaw 36 pulled apart to an open position by squeezing first handle 28 and second handle 38 together. Squeezing first handle 28 and second handle 38 together compresses gripper spring 40 and moves second jaw 36 away from first jaw 26. As shown in FIG. 2B, first nub 76 is formed on first jaw 26 and second nub 78 is formed on second jaw 36. First recess 59 is formed on first plate 16 and second recess 72 is formed on second plate 18. First recess 59 and second recess 72 are sized to receive first nub 76 and second nub 78 respectively. First nub 76 and second nub 78 mate with first recess 59 and second recess 72 respectively to give gripper tool 14 a strong hold on retention block 12 and reduce slippage between retention blocks 12 and gripper tool 14. Gripper seat 56 is a curved axial groove formed on an end of stem 54 of first plate 16. Gripper seat 56 provides a rest for bar 20 that helps guide first nub 76 and second nub 78 to first recess 59 and second recess 72 respectively. As discussed below with reference to FIGS. 3A-3C, gripper tool 14 and retention blocks 12 are used to back-up and immobilize bolts 81 on rear drum 80 so that shaft 82 can be assembled to rear drum 80 without losing any of bolts 81.

Figure 3A:
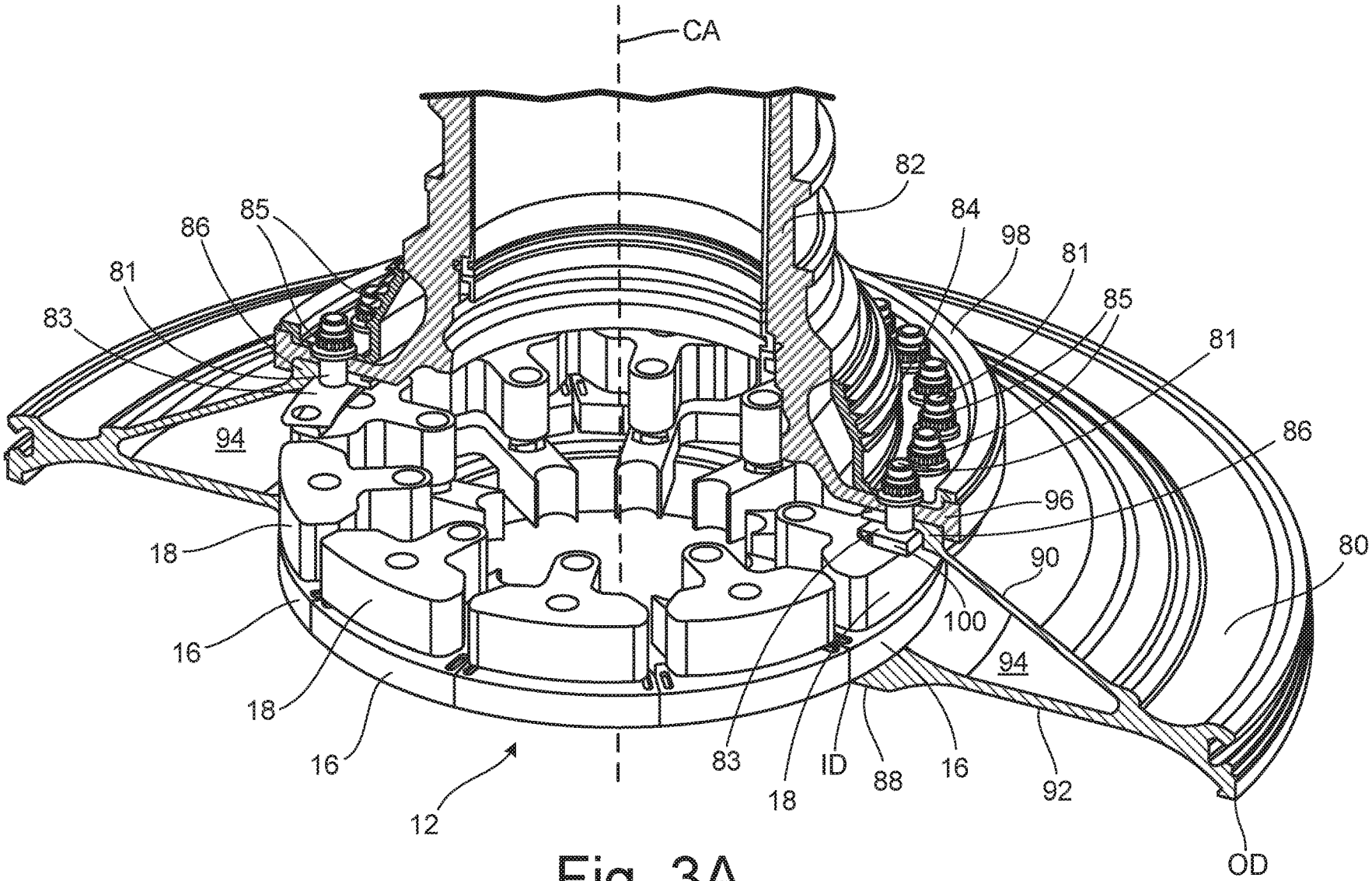
FIG. 3A is a partial cross-sectional view of a rear drum for a gas turbine engine compressor section, a rear shaft connected to the rear drum, and the plurality of retention blocks installed in the rear drum.
Figure 3B:
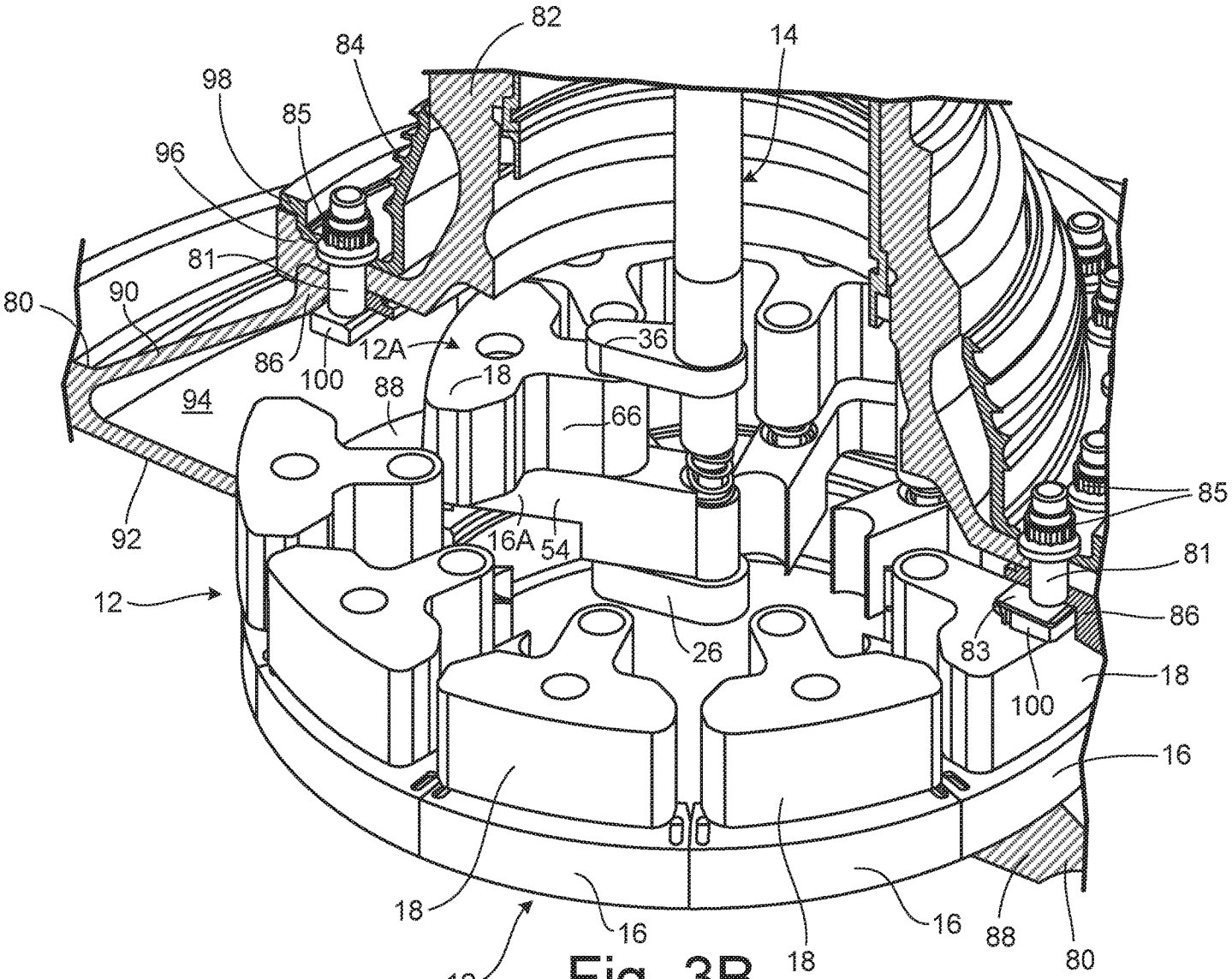
FIG. 3B is a partial cross-sectional view of the rear drum, the rear shaft, and the plurality of retention blocks from FIG. 3A along with the working end of the gripper tool removing one of the retention blocks from the rear drum.
Figure 3C:
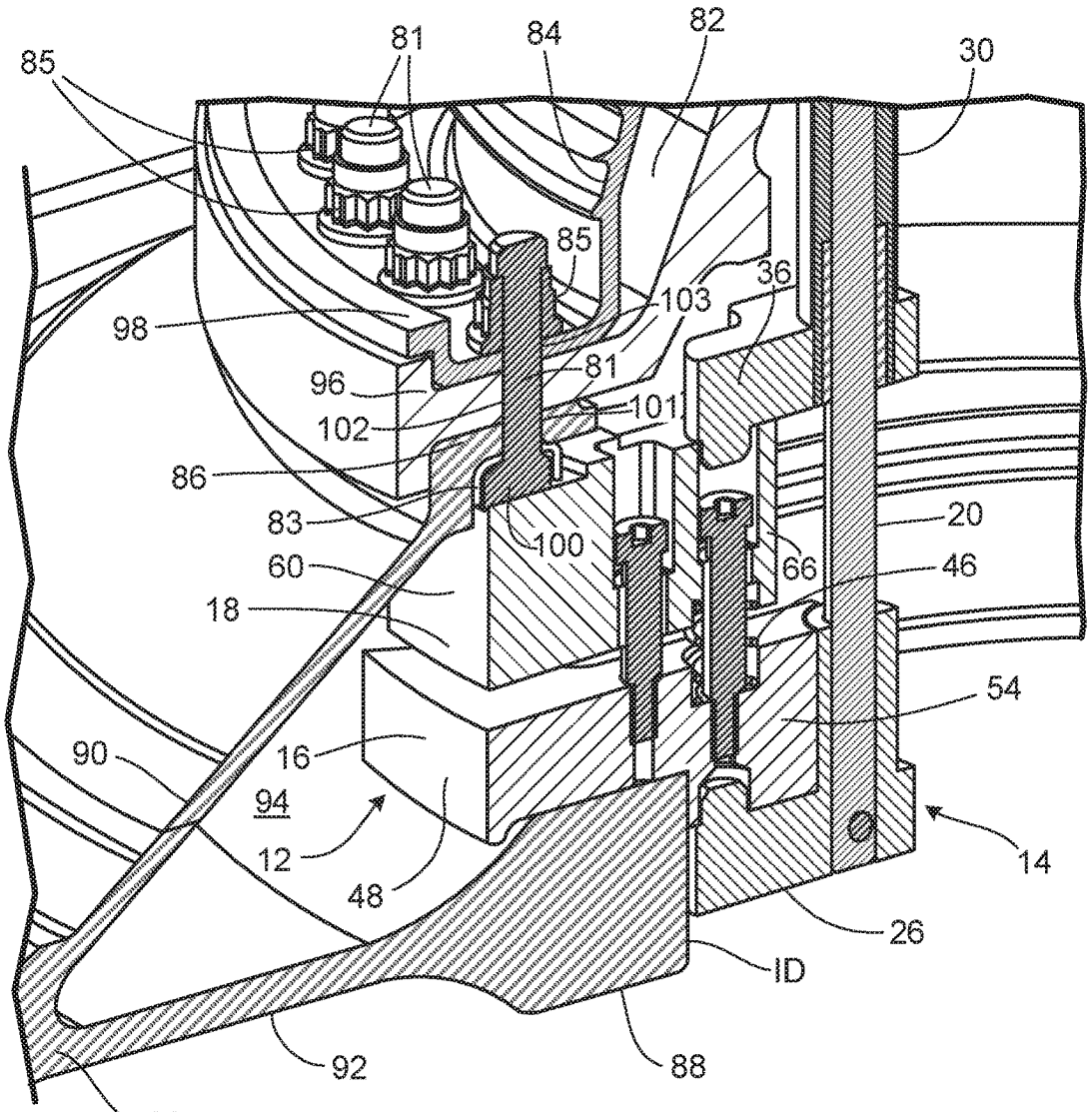
FIG. 3C is a cross-sectional view of the working end of the gripper tool, the rear drum, the rear shaft and one of the retention blocks from FIG. 3B.

FIGS. 3A-3C will be discussed concurrently. FIG. 3A is a partial cross-sectional view of rear drum 80, bolts 81, shaft 82, washers 83, knife seal 84, and assembly nuts 85 along with the plurality of retention blocks 12 installed in rear drum 80. FIG. 3B is another partial cross-sectional view of rear drum 80, shaft 82, knife seal 84, and retention blocks 12 with gripper tool 14 removing one of retention blocks 12 from rear drum 80. FIG. 3C is a cross-sectional view of rear drum 80, shaft 82, knife seal 84, one retention block 12 inside rear drum 80, and gripper tool 14 grasping retention block 12. Rear drum 80 can form an aft end of a high-pressure compressor section (not shown) of a gas turbine engine (also not shown). As shown best in FIG. 3C, rear drum 80 includes drum flange 86, hub 88, first webbing 90, second webbing 92, inner diameter ID, outer diameter OD (shown in FIG. 3A) and void 94. Shaft 82 includes shaft flange 96, and knife seal 84 includes seal flange 98. Each of bolts 81 includes a bolt head 100. A first set of holes 101 is formed in drum flange 86, a second set of holes 102 is formed in shaft flange 96, and a third set of holes 103 is formed in seal flange 98.

Rear drum 80 extends radially between inner diameter ID and outer diameter OD relative center axis CA. Drum flange 86 and hub 88 of rear drum 80 are both positioned on inner diameter ID and are spaced axially from one another. Drum flange 86 forms a first axial end of rear drum 80 and hub 88 forms a second axial end of rear drum 80. First webbing 90 extends between drum flange 86 and outer diameter OD, and second webbing 92 extends between hub 88 and outer diameter OD. Void 94 is formed between drum flange 86 and hub 88. Shaft 82 is a rear shaft that can be used to connect rear drum 80 to a high-pressure turbine section (not shown) of a gas turbine engine (not shown). The diameter of shaft flange 96 is sized to fit over drum flange 86, and the second set of holes 102 formed in shaft flange 96 are positioned on shaft flange 96 to align with the first set of holes 101 formed on drum flange 86. Knife seal 84 is sized to fit over shaft 82 such that seal flange 98 rests over shaft flange 96. The third set of holes 103 formed in seal flange 98 align with the first set of holes 101 and the second set of holes 102 when drum flange 86, shaft flange 96, and seal flange 98 are properly positioned. Bolts 81 extend out of rear drum 80 and through the first, second, and third sets of holes 101, 102, 103. Washers 83 are positioned inside of rear drum 80 between drum flange 86 and bolt heads 100. Each of washers 83 may include two holes (not labeled) to accommodate two bolts 81 for each washer 83. Assembly nuts 85 are threaded and torqued onto bolts 81 to securely attach knife seal 84 and shaft 82 to rear drum 80

Rear drum 80, shaft 82, and knife seal 84 are assembled together through vertical stacking on center axis CA. Retention blocks 12 are used during the assembly of rear drum 80, shaft 82, and knife seal 84 to retain bolts 81 and washers 83 on rear drum 80 and to prevent bolts 81 and washers 83 from falling out of position under the influence of gravity. First, to assemble rear drum 80, shaft 82, and knife seal 84 together, rear drum 80 is centered vertically on center axis CA with drum flange 86 positioned above hub 88. Rear drum 80 can be assembled onto a high-pressure compressor section (not shown) at this time. Next, washers 83 are installed onto bolts 81, and bolts 81 are inserted through the first set of holes 101 (shown in FIG. 3C) formed on drum flange 86. Bolts 81 are inserted through the first set of holes 101 such that bolt heads 100 and washers 83 are positioned inside rear drum 80 axially between drum flange 86 and hub 88. An annular spacer (not shown) with a thickness similar to the combined thicknesses of shaft flange 96 and seal flange 98 can be placed over drum flange 86 before inserting bolts 81 into the first set of holes 101. As bolts 81 are inserted through the first set of holes 101 (and the annular spacer if employed), working nuts (not shown) are temporarily threaded onto bolts 81 to prevent bolts 81 from falling out of the first set of holes 101 and down into void 94 of rear drum 80. After bolts 81 and washers 83 are in place on drum flange 86, the plurality of retention blocks 12 are installed inside rear drum 80.

Each retention block 12 is installed by pressing first plate 16 and second plate 18 together (by hand or otherwise), which compresses block spring 46 between first plate 16 and second plate 18, and positioning head 48 and body 60 axially between bolt heads 100 and hub 88. Once in position between bolt heads 100 and hub 88, retention block 12 is released, causing block spring 46 to decompress and push first plate 16 into contact with hub 88 and push second plate 60 into contact with bolt heads 100. In like manner, each retention block 12 is installed inside rear drum 80 in a circular manner about center axis CA, with modified retention block 12A (shown in FIG. 2C) being the last of the plurality of retention blocks 12 to be installed inside rear drum 80. After all of the plurality of retention blocks 12 installed between bolt heads 100 and hub 88, every bolt head 100 is backed-up and sandwiched between drum flange 86 and one of the plurality of retention blocks 12. Next, the working nuts (not shown) are removed from bolts 81. The annular spacer (also not shown), if used, is removed from bolts 81 and drum flange 86. Shaft 82 is then aligned over rear drum 80 and lowered onto rear drum 80 such that shaft flange 96 rests on drum flange 86 and bolts 81 extend through the second set holes 102 (shown in FIG. 3C). Knife seal 84 is then lowered over shaft 82 and aligned such that seal flange 98 rests on shaft flange 96 and bolts 81 extend through the third set of holes 103 formed in seal flange 98. Assembly nuts 85 are then threaded onto bolts 81 and torqued tight.

After shaft 82 is attached to rear drum 80, modified retention block 12A (shown in FIG. 2C) is compressed by pressing first plate 16A and second plate 18 together, and modified retention block 12A is pulled out from between bolt heads 100 and drum 88, and lifted out of rear drum 80 and shaft 82 along center axis CA. In like manner, each retention block 12 is removed until the entire plurality of retention blocks 12 have been removed from rear drum 80. With shaft 82 connected to rear drum 82, reaching retention blocks 12 to remove retention blocks 12 may be difficult by hand, especially if a high-pressure compressor section (not shown) is connected vertically under rear drum 82. Gripper tool 14 is used to reach down shaft 82 and to securely grab and remove each retention block 12. First jaw 26 and second jaw 36 are lowered through shaft 82 and into rear drum 80. First handle 28 and second handle 38 are squeezed together to open and spread first jaw 26 and second jaw 36 apart. Gripper tool 14 is maneuvered into place against gripper seat 56 on first plate 16 such that first nub 76 and second nub 78 are aligned with first recess 59 and second recess 72 (shown best in FIG. 2B). Once in place, first handle 28 and second handle 38 are released and gripper spring 40 (shown in FIG. 1) closes first jaw 26 and second jaw 36 onto retention block 12. Gripper tool 14 and retention block 12 are then pulled out of rear drum 80 and shaft 82. The above process is repeated with gripper tool 14 to remove all retention blocks 12 from rear drum 80.

In view of the foregoing description, it will be recognized that the present disclosure provides numerous advantages and benefits. For example, the present disclosure provides retention blocks 12 to back-up and immobilize blots 81 on rear drum 80 so that shaft 82 can be assembled to rear drum 80 without losing any of bolts 81 inside of rear drum 80, or inside of a high-pressure compressor section (not shown) connected to rear drum 80. The present disclosure also provides gripper tool 14 for reaching and removing retention blocks 12 when retention blocks 12 cannot be reached by hand.

The following are non-exclusive descriptions of possible embodiments of the present invention.

In one embodiment, an immobilizer tool set includes a plurality of retention blocks. Each retention block of the plurality of retention blocks includes a first plate, a guide pin extending from the first plate, and a second plate on the guide pin and configured to slide on the guide pin relative the first plate. A spring is between the first plate and the second plate.

The immobilizer tool set of the preceding paragraph can optionally include, additionally and/or alternatively, any one or more of the following features, configurations and/or additional components:

the plurality of retention blocks are configured for assembly about a center axis, and wherein the first plate of at least one retention block of the plurality of retention blocks comprises: a head extending circumferentially between a first end and a second end relative the center axis, and extending axially from a first surface to a second surface relative the center axis; and a stem extending radially inward from the head relative the center axis, wherein the guide pin extends axially from the stem;

the plurality of retention blocks form a circle about the center axis;

a circumferential length of the head tapers radially inward;

the second plate of the at least one retention block comprises: a body extending circumferentially between a first end and a second end relative the center axis, and extending axially from a first surface to a second surface relative the center axis; and a projection extending radially inward from the body relative the center axis, wherein the guide pin extends axially into the projection;

the at least one retention block further comprises: a second guide pin extending axially from the stem and into the projection;

the body is circumferentially shorter than the head;

the first plate of a second retention block of the plurality of retention blocks comprises a head that is circumferentially shorter than a body of the second plate of the second retention block;

the spring is around the guide pin and compressed between the first plate and the second plate;

a gripper tool comprising: a bar extending between a first end and a second end; a first jaw connected to the first end of the bar; a first handle connected to the second end of the bar; a tube extending between a first end of the tube and a second end of the tube, wherein the bar is longer than the tube and the bar extends through the tube; a second jaw connected to the first end of the tube; a second handle connected to the second end of the tube; and a second spring extending between the second end of the tube and the first handle; and/or the first jaw comprises a first nub, the first plate comprises a first recess configured to receive the first nub, the second jaw comprises a second nub, and the second plate comprises a second recess configured to receive the second nub.

In another embodiment, a method is disclosed for retaining bolts and washers on a rear drum of a gas turbine engine high-pressure compressor section prior to assembling a shaft to the rear drum. The method includes installing the washers on the bolts, and inserting the bolts through holes formed on a first end of the rear drum such that bolt heads of the bolts and the washers are positioned axially between the first end and a second end of the rear drum. The method further includes attaching work nuts to the bolts and installing a plurality of spring-loaded retention blocks between the second end of the rear drum and the bolt heads. Installing the plurality of spring-loaded retention blocks further includes compressing each spring-loaded retention block, inserting each compressed spring-loaded retention block between the bolt heads and the second end of the rear drum, and decompressing each spring-loaded retention block such that each spring-loaded retention block contacts the second end of the rear drum and at least one of the bolt heads.

The method of the preceding paragraph can optionally include, additionally and/or alternatively, any one or more of the following features, configurations and/or additional components:

placing a spacer on the bolts after inserting the bolts through the holes on the first end of the rear drum and before attaching the work nuts to the bolts;

removing the work nuts from the bolts after installing the plurality of spring-loaded retention blocks between the bolt heads and the second end of the rear drum; and/or each spring-loaded retention block comprises a first plate, a second plate, a guide pin extending from the first plate into the second plate, and a spring between the first plate and the second plate, wherein compressing each spring-loaded retention block further comprises: pressing the first plate and the second plate together and compressing the spring between the first plate and the second plate.

In another embodiment, a method is disclosed for assembling a shaft to a rear drum of a high-pressure compressor section in a gas turbine engine. The method includes installing washers onto bolts and inserting the bolts through a first set of holes formed on a first end of the rear drum such that bolt heads of the bolts and the washers are positioned axially between the first end and a second end of the rear drum. The method further includes attaching work nuts to the bolts and installing a plurality of retention blocks between the second end of the rear drum and the bolt heads. The plurality of retention blocks are installed by compressing each retention block, inserting each compressed retention block between the second end of the rear drum and the bolt heads, and decompressing each retention block such that each retention block contacts the second end of the rear drum and at least one of the bolt heads. The method further includes removing the work nuts from the bolts, aligning a flange of the shaft with the first end of the rear drum such that the bolts extend through a second set of holes formed in the flange of the shaft, and attaching assembly nuts to the bolts.

The method of the preceding paragraph can optionally include, additionally and/or alternatively, any one or more of the following features, configurations and/or additional components:

placing a spacer on the bolts after inserting the bolts through the holes on the first end of the rear drum and before attaching the work nuts to the bolts; and removing the spacer after removing the work nuts from the bolts and before aligning the flange of the shaft with the first end of the rear drum;

each retention block comprises a first plate, a second plate, a guide pin extending from the first plate into the second plate, and a spring between the first plate and the second plate, wherein compressing each retention block further comprises: pressing the first plate and the second plate together and compressing the spring between the first plate and the second plate;

decompressing each retention block further comprises: releasing the first plate and the second plate such that the spring decompresses and pushes the first plate against the second end of the rear drum and pushes the second plate against the bolt heads; and/or removing the plurality of retention blocks from between the second end of the rear drum and the bolt heads after attaching the assembly nuts to the bolts by: compressing each retention block; and removing each compressed retention block from between the bolt heads and the second end of the rear drum.

Any relative terms or terms of degree used herein, such as "substantially", "essentially", "generally", "approximately", and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, transitory vibrations and sway movements, temporary alignment or shape variations induced by operational conditions, and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An immobilizer tool set comprising:

a plurality of retention blocks configured for assembly about a center axis, wherein each retention block of the plurality of retention blocks comprises:

a first plate comprising:

a head extending circumferentially between a first end and a second end relative the center axis, and extending axially from a first surface to a second surface relative the center axis; and a stem extending radially inward from the head toward the center axis;

wherein the guide pin extends axially from the stem;

a guide pin extending from the first plate;

a second plate on the guide pin and configured to slide on the guide pin relative the first plate, the second plate comprising:

a body extending circumferentially between a first end and a second end relative the center axis, and extending axially from a first surface to a second surface relative the center axis; and a projection extending radially inward from the body toward the center axis;

wherein the guide pin extends axially into the projection;

a second guide pin extending axially from the stem and into the projection; and a spring between the first plate and the second plate.

2. The immobilizer tool set of claim 1, wherein the plurality of retention blocks form a circle about the center axis.

3. The immobilizer tool set of claim 1, wherein a circumferential length of the head tapers radially inward.

4. The immobilizer of claim 1, wherein the spring is around the guide pin and compressed between the first plate and the second plate.

5. The immobilizer tool set of claim 1, wherein the body is circumferentially shorter than the head.

6. The immobilizer tool set of claim 5, wherein the first plate of a second retention block of the plurality of retention blocks comprises a head that is circumferentially shorter than a body of the second plate of the second retention block.

7. The immobilizer tool set of claim 1 and further comprising:

a gripper tool comprising:

a bar extending between a first end and a second end;

a first jaw connected to the first end of the bar;

a first handle connected to the second end of the bar;

a tube extending between a first end of the tube and a second end of the tube, wherein the bar is longer than the tube and the bar extends through the tube;

a second jaw connected to the first end of the tube;

a second handle connected to the second end of the tube; and a second spring extending between the second end of the tube and the first handle.

8. The immobilizer tool set of claim 7, wherein the first jaw comprises a first nub, the first plate comprises a first recess configured to receive the first nub, the second jaw comprises a second nub, and the second plate comprises a second recess configured to receive the second nub.

9. An immobilizer tool set comprising:

a plurality of retention blocks, wherein each retention block of the plurality of retention blocks comprises:

a first plate;

a guide pin extending from the first plate;

a second plate on the guide pin and configured to slide on the guide pin relative the first plate; and a spring between the first plate and the second plate; and a gripper tool comprising:

a bar extending between a first end and a second end;

a first jaw connected to the first end of the bar;

a first handle connected to the second end of the bar;

a tube extending between a first end of the tube and a second end of the tube, wherein the bar is longer than the tube and the bar extends through the tube;

a second jaw connected to the first end of the tube;

a second handle connected to the second end of the tube; and a second spring extending between the second end of the tube and the first handle.

10. The immobilizer of claim 9, wherein the spring is around the guide pin and compressed between the first plate and the second plate.

11. The immobilizer tool set of claim 9, wherein the first jaw comprises a first nub, the first plate comprises a first recess configured to receive the first nub, the second jaw comprises a second nub, and the second plate comprises a second recess configured to receive the second nub.

12. The immobilizer tool set of claim 9, wherein the plurality of retention blocks are configured for assembly about a center axis, and wherein the first plate of at least one retention block of the plurality of retention blocks comprises:

a head extending circumferentially between a first end and a second end relative the center axis, and extending axially from a first surface to a second surface relative the center axis; and a stem extending radially inward from the head toward the center axis, wherein the guide pin extends axially from the stem.

13. The immobilizer tool set of claim 12, wherein the plurality of retention blocks form a circle about the center axis.

14. The immobilizer tool set of claim 12, wherein a circumferential length of the head tapers radially inward.

15. The immobilizer tool set of claim 12, wherein the second plate of the at least one retention block comprises:

a body extending circumferentially between a first end and a second end relative the center axis, and extending axially from a first surface to a second surface relative the center axis; and a projection extending radially inward from the body toward the center axis, wherein the guide pin extends axially into the projection.

16. The immobilizer tool set of claim 15, wherein the at least one retention block further comprises:

a second guide pin extending axially from the stem and into the projection.

17. The immobilizer tool set of claim 15, wherein the body is circumferentially shorter than the head.

18. The immobilizer tool set of claim 17, wherein the first plate of a second retention block of the plurality of retention blocks comprises a head that is circumferentially shorter than a body of the second plate of the second retention block.

* * * * *